US005507227A

United States Patent [19]

Frazer

[11] Patent Number: 5,507,227

[45] Date of Patent: Apr. 16, 1996

[54] PRINTING APPARATUS WITH INTERNAL PRINT ROLL HEATING STRUCTURE

[75] Inventor: Geoffrey L. Frazer, Armidale, Australia

[73] Assignee: Frazer Engineering Co. Pty Ltd., New South Wales, Australia

[21] Appl. No.: 234,813

[22] Filed: Apr. 28, 1994

[51] Int. Cl.[6] ..... B41F 5/00

[52] U.S. Cl. ..... 101/329; 118/202; 219/216

[58] Field of Search ..... 101/487, 488, 101/295, 329, 25, 28, 31; 400/120.01; 346/157, 159; 219/216, 261, 262, 388; 118/202

[56] References Cited

U.S. PATENT DOCUMENTS

| | | | |
|---|---|---|---|
| 3,230,106 | 1/1966 | West | 101/487 |
| 3,255,695 | 6/1966 | Johnson et al. | 101/487 |
| 4,114,021 | 9/1978 | Nishide et al. | 219/216 |
| 4,528,908 | 7/1985 | Davison et al. | 101/295 |
| 4,559,872 | 12/1985 | Perra, Jr. . | |
| 4,627,342 | 12/1986 | Yui . | |
| 4,693,179 | 9/1987 | Watts | 101/129 |
| 4,792,860 | 12/1988 | Kuehnle | 346/157 |
| 5,287,155 | 2/1994 | Arai et al. | 219/216 |

*Primary Examiner*—Eugene H. Eickholt
*Attorney, Agent, or Firm*—Howson and Howson

[57] ABSTRACT

A printing apparatus and method, which uses an ink composition which is at ambient temperatures and which becomes liquid when heated. The apparatus (1) has an ink roller (2) and a print drum (3). The ink roller (2) is for inking the printing elements (4) provided on the print drum (3). A heating block (5) surrounds and radiantly heats the ink roller (2). To maintain the print drum at elevated temperatures, heating elements (8) are provided in the print drum (3). Circuitry is provided to control the temperature of the heating elements (8) and/or heating blocks (5). The apparatus may be clutch or stepper motor driven, and supplied within a packaging machine to print batch or date or codes or the like onto packaging material.

14 Claims, 8 Drawing Sheets

PRINTING APPARATUS WITH INTERNAL PRINT ROLL HEATING STRUCTURE

BACKGROUND OF THE INVENTION

The present invention relates to a printing apparatus and method, and in particular, to a printing apparatus and method which uses an ink composition of the type which is solid at ambient temperatures and which is liquid when heated to elevated temperatures. The present invention is also particularly related to a control means for controlling the operation of the heating means associated with heating the ink roller and other portions of the printing apparatus.

DESCRIPTION OF PRIOR ART

Various types of apparatus are known for printing date codes, bar codes, batch codes, and the like, on packaging materials at the time of packaging products.

The most useful of these printing apparatus are those which utilise an ink composition of the type which is solid at ambient temperatures and which is liquid when heated to elevated temperatures. The advantage of using such an ink composition is that after application of the code or other printed indicia on the packaging, it then cools and dries quickly. Consequently, it is possible to handle the packaging almost immediately after printing without the danger of smearing the printed image.

The use of such said ink compositions also facilitates easier handling and replacement of the ink rollers associated with such printing machines.

SUMMARY OF THE INVENTION

The present invention seeks to provide a printing apparatus which utilises a unique configuration of heating elements associated with the ink roller and print drum. to heat a 'solid' ink composition and the printing elements, to the required elevated temperatures necessary to perform the printing operation.

The present invention also seeks to provide a control device for controlling the operation of the heating elements of the printing apparatus.

In one broad form, the present invention provides a printing apparatus, comprising:

a print drum having at least one printing element thereon;

an ink roller, for inking the printing element(s), with an ink composition of the type which is solid at ambient temperatures and which is liquid at elevated temperatures.

a heating block at least partially surrounding said ink roller, to radiantly heat said ink roller; and, heating means within said print drum to heat said printing element.

Preferably, the device further comprises control means to control the heating operation of said heating block and/or heating means.

Most preferably, each said printing element(s) is/are comprised of a moulded silicone polymer.

A preferred embodiment of the invention is wherein said inking roller is eccentrically mounted.

The preferred embodiment of the invention is wherein said heating block substantially surrounds said ink roller.

The present invention is most useful for printing a batch code, date code or other printed indicia at spaced intervals on a web of material to be used as packaging.

A most preferred embodiment of the invention is wherein to control the temperature of said heating block and/or said heating means, said control means comprises:

summing means to sum the said temperature signal to a periodically variable waveform signal;

comparator means to compare said summed signal with a preset temperature value; and, switching means to operate said heating block and/or said heating means when said summed signal is larger than said preset value.

The most preferred form is wherein said periodically variable waveform signal is a triangular waveform signal.

Most preferably once said summed signal is larger than said preset value, a start signal is provided to convey material to be printed thereon under said print drum.

The preferred function of the device of the present invention is wherein said material is a web of film of packaging material.

Preferably, the printing apparatus comprises monitoring means to monitor the position and/or quality of said printed material and provide a feedback signal to control the further operation of said apparatus and/or speed of said material to be printed thereon.

Also preferably, the printing apparatus further comprises trigger means to prevent noise and/or other signals causing incorrect start signals.

Also preferably, said trigger means comprises an oscillator driving a counter, a start signal only being provided when a predetermined number of increments are received from said control.

In a preferred form movement of said print drum and said web of material through said apparatus is achieved by a clutch drive.

In an alternatively preferred form movement of said print drum and said web of material through said apparatus is achieved by a stepper motor drive.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENT(S)

Figure 1:
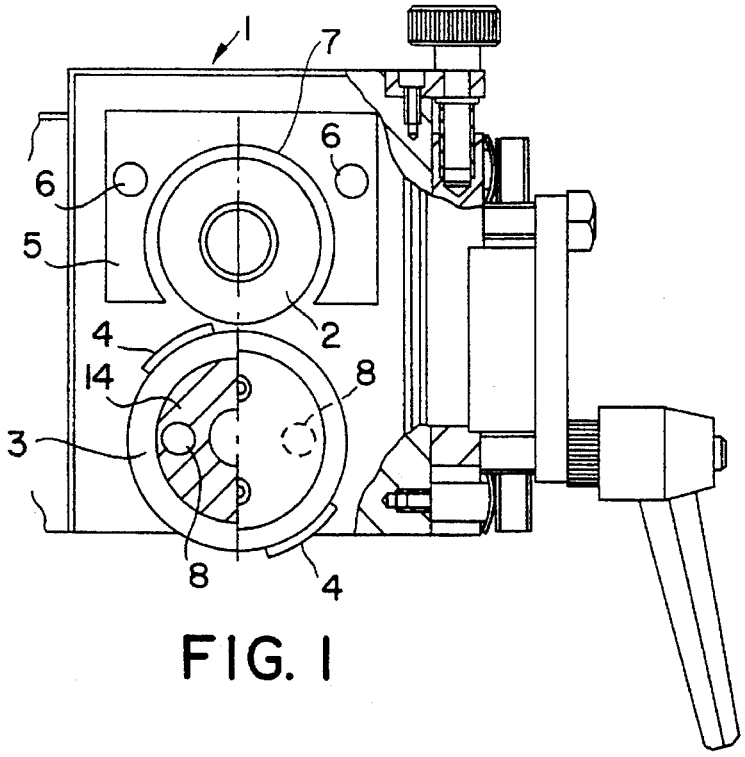
FIG. 1 details the printing apparatus of the present invention showing the heating block and heating elements thereof.
Figure 2A:
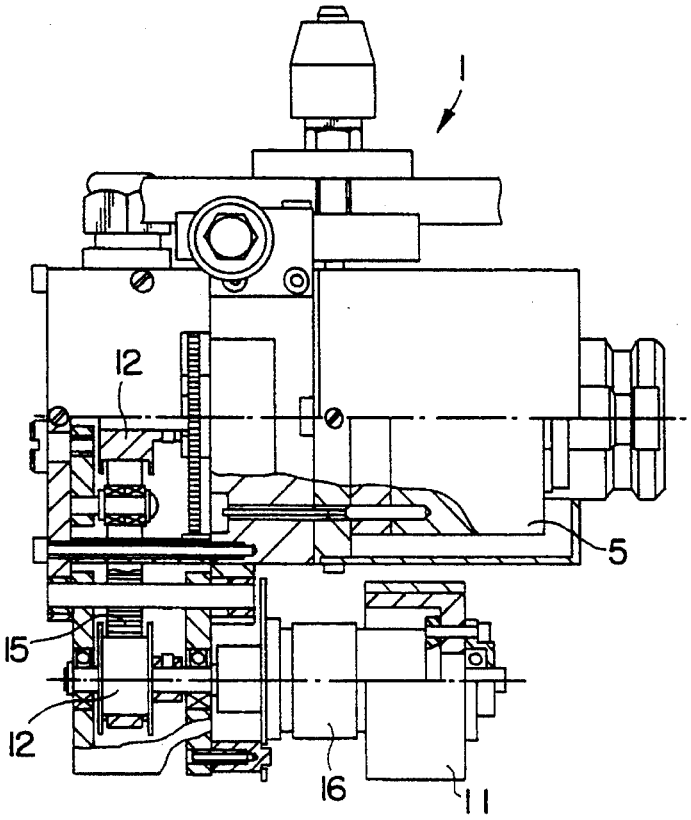
FIG. 2 shows various views, in FIGS. 2(*a*) to 2(*g*) thereof, of the printing apparatus of the present invention operated by using a clutch drive, through which a web of material is passed during a printing operation.
Figure 2B:
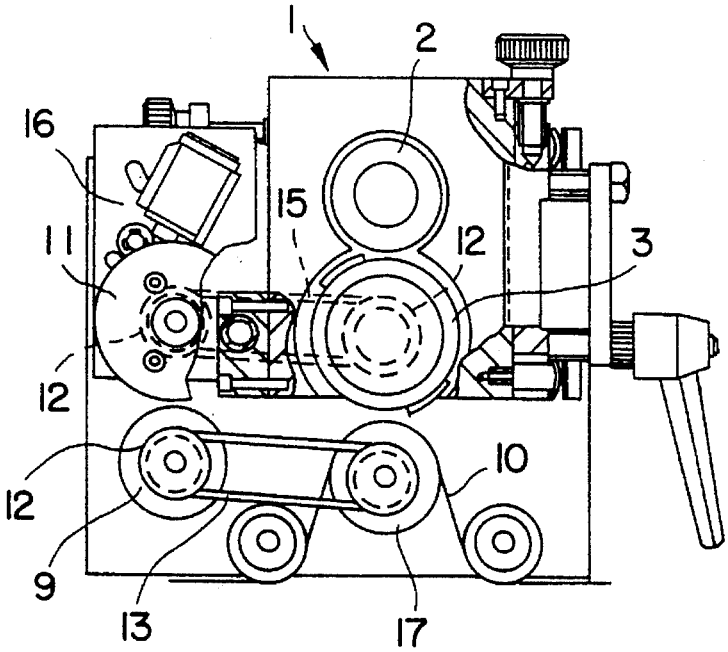
Figure 2C:
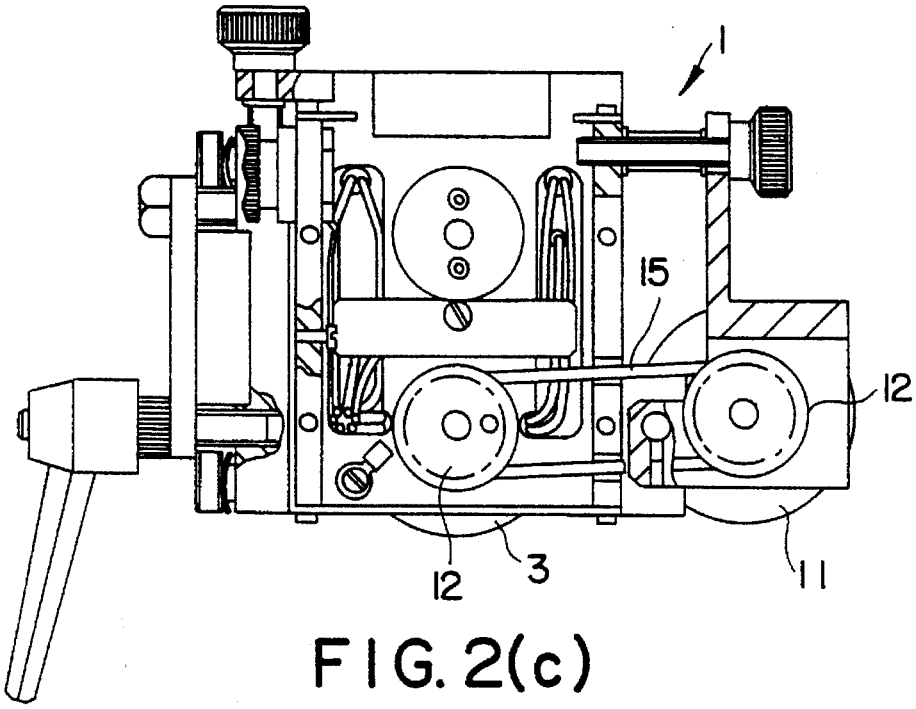
Figure 2D:
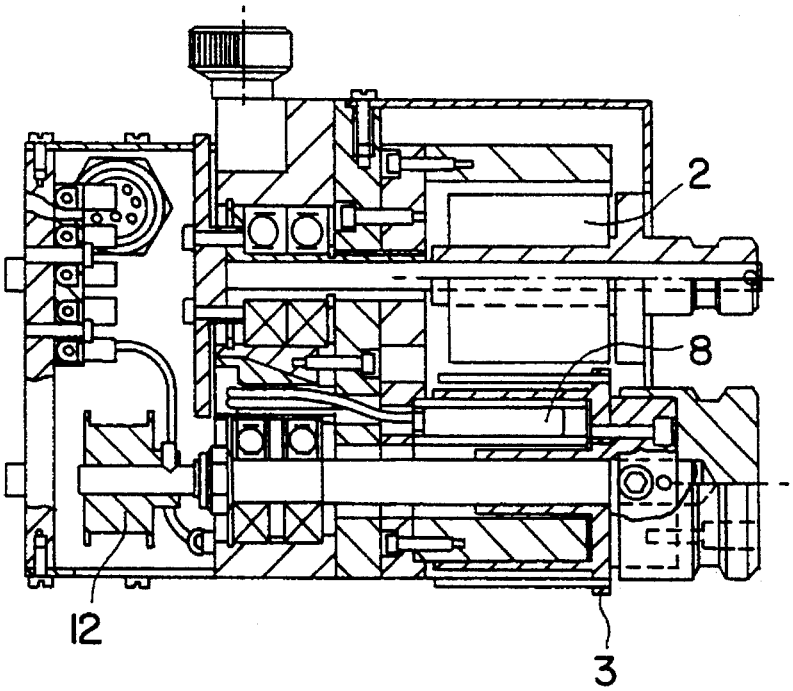
Figure 2E:
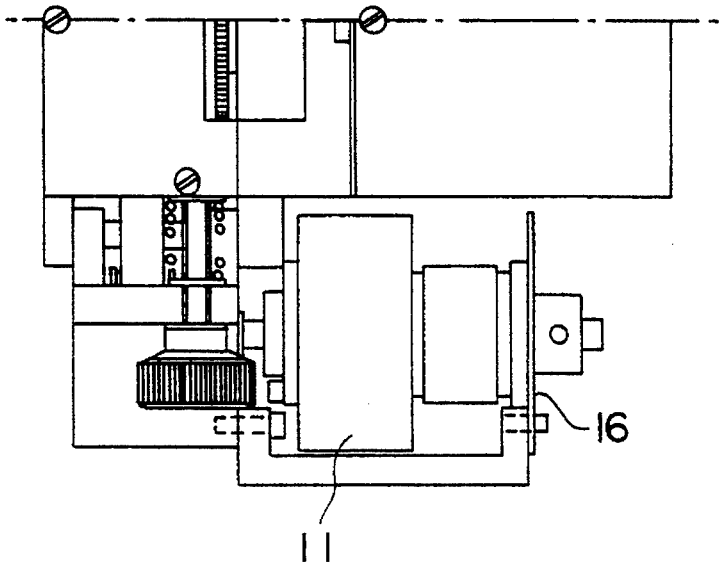
Figure 2G:
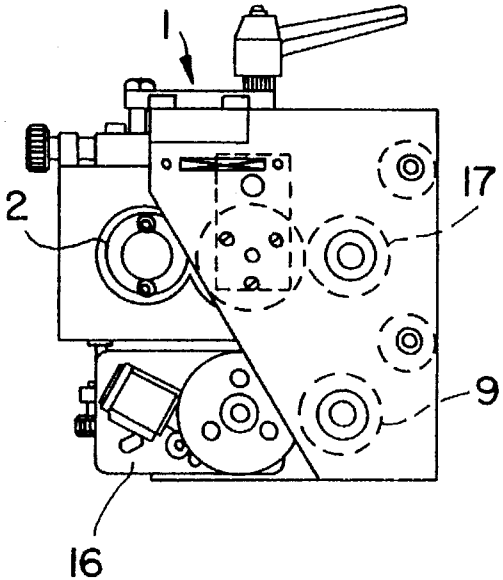
Figure 2F:
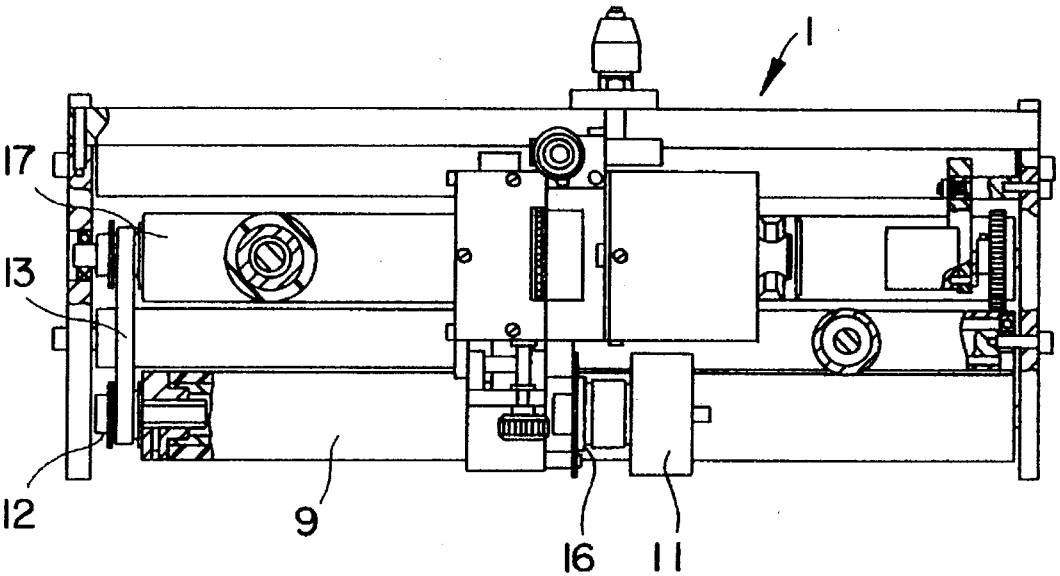

Throughout the description, like numerals will be used to represent similar features in the various drawings.

A printing apparatus, generally designated by the numeral 1 comprises an ink roller 2 and a print drum 3. The ink roller 2 is for inking the printing elements 4 provided on the print drum 3, and is formed of an ink composition of the type which is solid at ambient or normal room temperatures, and which turns liquid or flowable when heated at elevated temperatures. To heat the ink composition of the ink roller 2, a heating block 5 is provided substantially surrounding the ink roller. The heating block 5 may for example be heated by heating elements 6 contained at spaced apart locations in the heating block 5, to heat the block 5. Radiant heat is dispersed from the surface 7 towards the outer portions of the ink roller 2 to effectively heat the ink composition on that outer surface, such that it is changed from a solid to a liquid phase. As the print drum 3 is rotated, printing elements 4 spaced therearound, contact the ink roller 2 such that liquid ink from the ink roller 2 is provided onto the outer surface of the printing elements 4. The printing elements 4 are then rotated to the printing location at the lower portion of the device such where the ink is supplied onto the web of material which is passed through the printing apparatus. To maintain the print drum 3 at an elevated temperature such that the ink does not revert to the solid phase whilst in contact with the elements 4, heating elements 8 are additionally provided within cylindrical block 14 in close proximity to the print drum 3. Therefore, heating of the ink composition is initially achieved by radiant heat, radiated from the heating block 5 towards the ink roller 2, and then, to retain the ink in a flowable state whilst on printing elements 4, conductive heat is provided from heating elements 8 in the central position of the print drum 3. Various web-driven rollers 9 are located as desired to convey the web of material 10 through the apparatus.

Operation of the printing apparatus 1 is achieved in various forms. FIG. 2 details various views of the printing apparatus which is driven by a clutch drive, whilst FIG. 6 details an alternatively preferred form of a printing apparatus which is driven by a stepper motor drive. FIG. 2 shows, in FIG. 2(*a*) to 2(*g*) thereof, details of a preferred embodiment of a printing apparatus which is operated by a clutch drive FIG. 2(*a*) shows a plan view of the apparatus, FIG. 2(*b*), (*c*) and (*d*) showing right, left and front elevational views of the apparatus of FIG. 2(*a*). In FIG. 2(*c*) is shown details of the clutch reversal assembly, whilst FIG. 2(*f*) and 2(*g*) show, in plan and right hand side elevation, how the printing apparatus may be connected via a bracket arrangement into a packaging machine—whereby the printing apparatus may be easily adjusted in position.

The apparatus of FIG. 2 is operated by driving means 11, that is a friction roller fixed to a clutch 16, which may, for example be connected via belts or gears, and which is driven by the web 10 through rollers 9 and 17. For instance a friction roller 11 attached to the clutch 16 may be driven by a roller 9 in contact with it. Roller 9 may be driven by a similar roller below the print drum 3 and which is rotated by the web 10 travelling past. Thus rollers 9 and 17 which are connected by the belt 13 turn the friction roller 11 continuously until the clutch 16 is signalled to operate, which rotates the print drum 3 via pulleys 12 and a belt 15.

It will be appreciated that a wide variety of alternative embodiments for conveying the web of material 10 through the printing apparatus 1 and operating of the overall device will be understood to persons skilled in the art. One such variation will be detailed hereinafter in FIG. 6. All such embodiments should be considered to fall within the scope of the invention.

The present invention also provides means for controlling the operation of such a printing apparatus 1 including temperature control, identifying and confirming correct print position, preventing noise to affect the apparatus 1, etc. These features will be described herein below.

Figure 3:
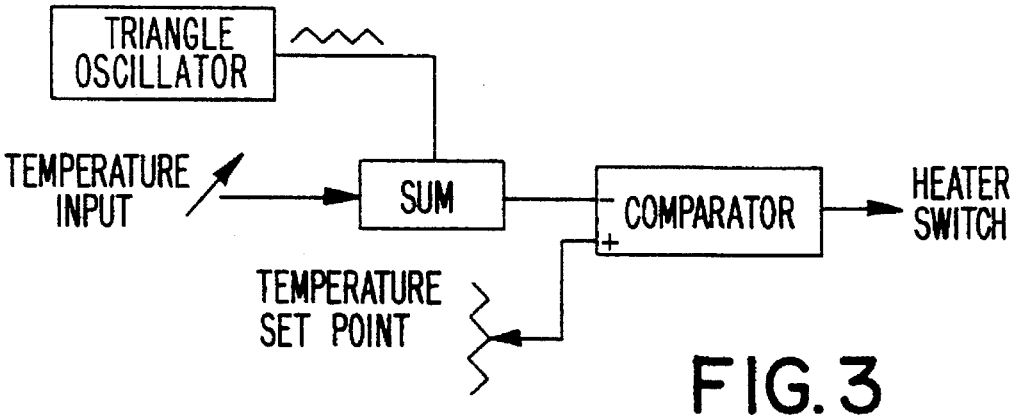
FIG. 3 shows a block diagram of a heater control circuit, for fast and accurate temperature control of the heating means.

FIG. 3 shows a control means, to control the heating operation of the heating portions of the apparatus, namely, the heating block 5 and the heating elements 6. Prior art devices are slow in heating and it is not uncommon for them to take up to 20 minutes to reach suitable operating temperatures. Furthermore, temperature variations are considerable, eg. + or −10 degrees C. In prior art printing devices it has been noted that if they are brought into operation before the correct operating temperatures are reached, the ink roller may be torn or damaged and as a result illegible printing is produced or the roller will require replacement before it has provided its full print potential. The means of overcoming these problems forms a part of this invention, such that, only after the operational heat setting has been reached will an output signal be produced which allows the input signal to trigger the clutch and also allow the packaging machine to become operational.

The control circuit of the present invention is arranged to permit a higher temperature than that selected for correct operation, for a predetermined time. Following this time a proportional heat control method is used wherein a triangular voltage from a slow running oscillator is added to the temperature input voltage, the oscillator voltage being equivalent to several degrees celsius. When the temperature reaches the set point, the peaks of the triangular waveform switch the heaters off momentarily, thus slowing the rate of heating. As the temperature rises further, the heaters are progressively switched off for longer times in the oscillator cycle until heat equilibrium is reached at the set point and is maintained within close tolerances.

The hot roll devices are normally fitted in a suitable position in a packaging machine and are required to print a batch code, date code or other printed indicia at regular spaced intervals on the film that is used to wrap the products. In many cases the print is to be placed accurately within a delineated space thus requiring the print head in the device to be accurately controlled. During the process of forming and sealing a bag for packaging various sizes of products, the film can be advanced and slowed with irregular accelerations, and can vary as the machine speed is varied. By using a microswitch or photoeye to initiate the cycle and a time delay control, the print position can vary as the film can advance different distances in the same time setting. The present invention incorporates an electronic circuit using the output of an encoder which is arranged to be in constant contact with the film thus ensuring that the print position is maintained regardless of the speed variations of the film and speed changes of the machine.

A common fault with heated ink devices is the irregular triggering of the device due to electrical noise from switching in the parent packaging machine or from the microswitch trigger or other spikes.

Figure 4:
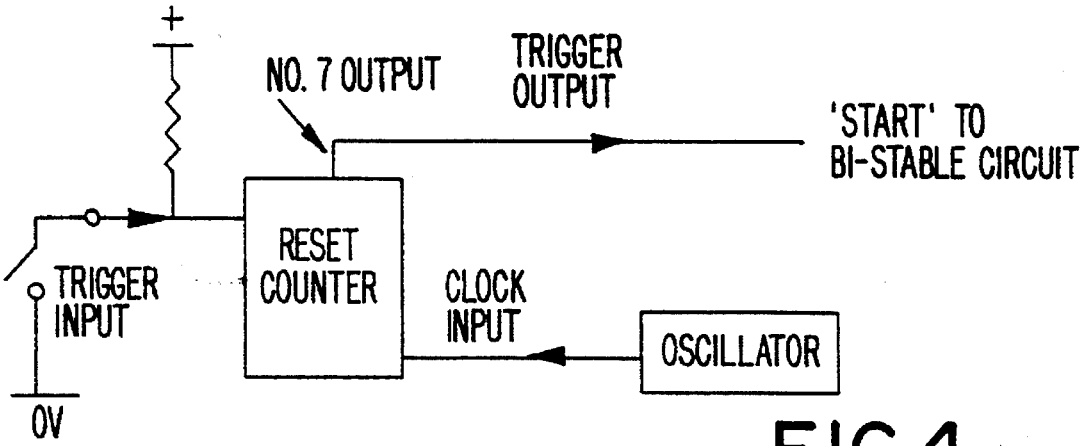
FIG. 4 shows a block diagram of a trigger input circuit, to avoid incorrect start signals from affecting the operation of the control circuit due to 'noise' from the microswitch; and, FIG. 5 shows a block diagram of a digital positioning delay circuit, to maintain a constant delay to the clutch.
Figure 5:
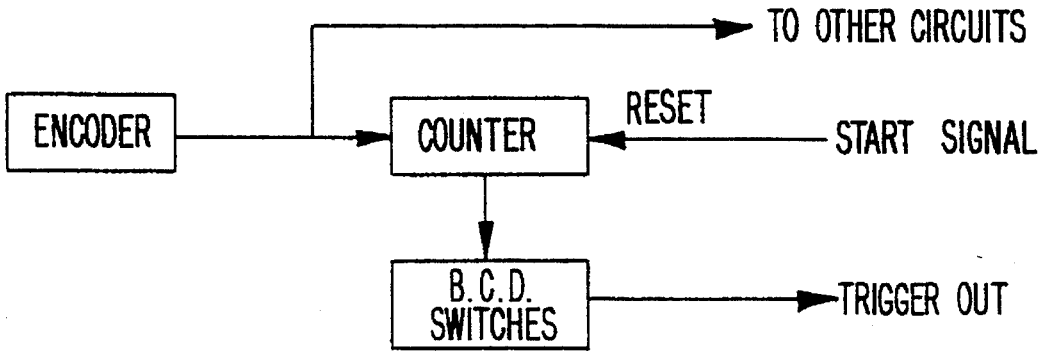
Figure 6A:
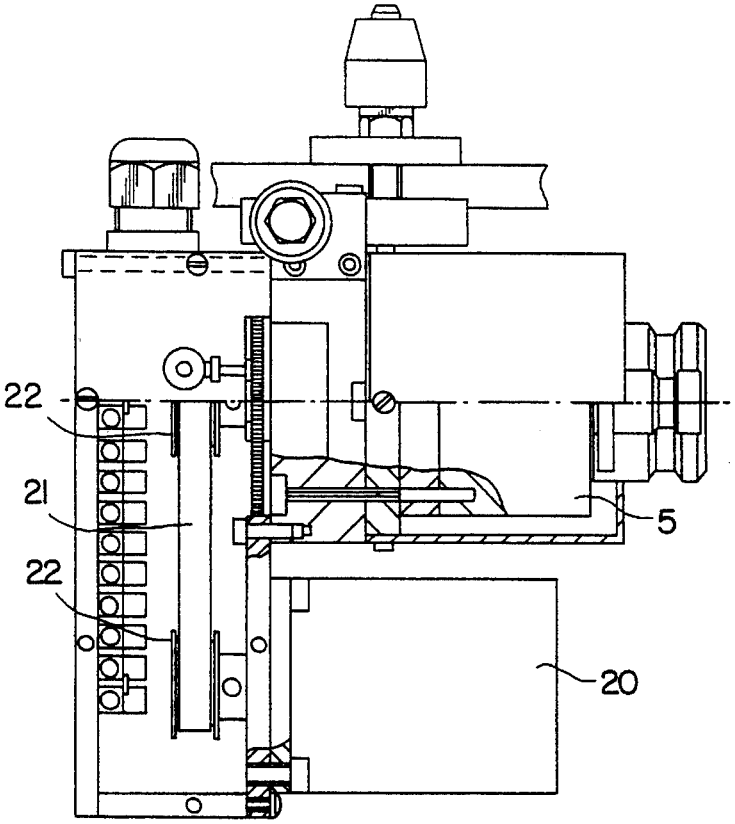
FIG. 6 shows various views, in FIGS. 6(*a*) to 6(*g*) thereof, of the printing apparatus of the present invention operated by using a stepper motor drive, below which a web of material is passed during a printing operation.
Figure 6B:
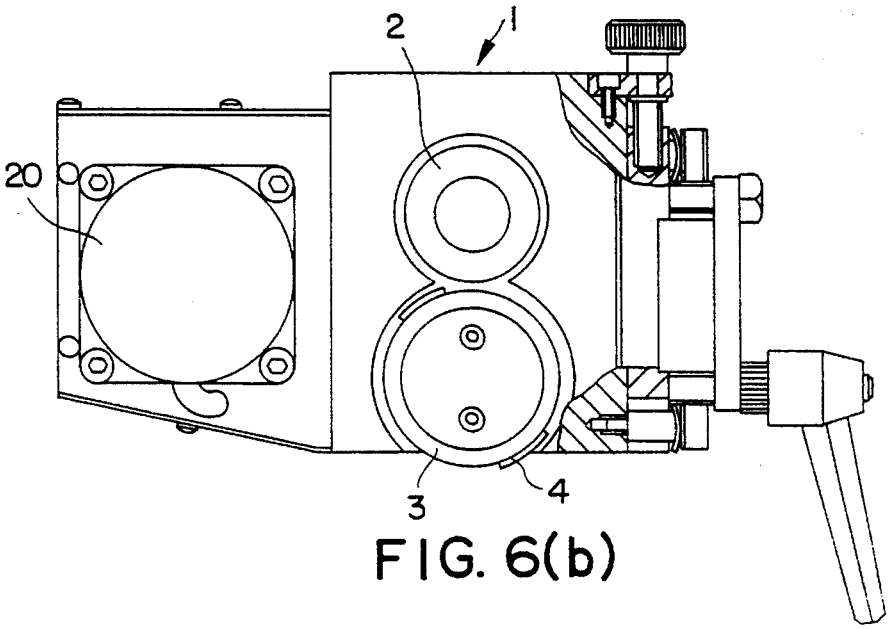
Figure 6C:
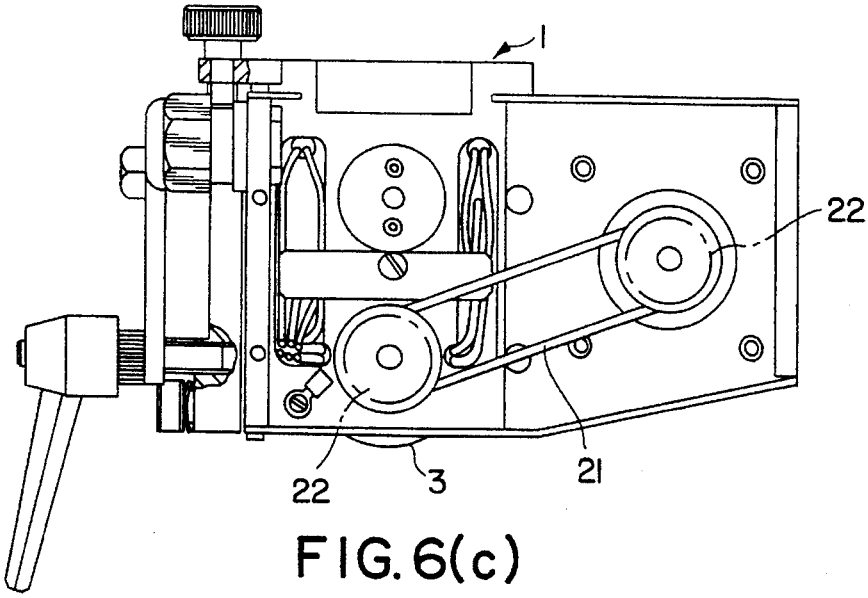
Figure 6D:
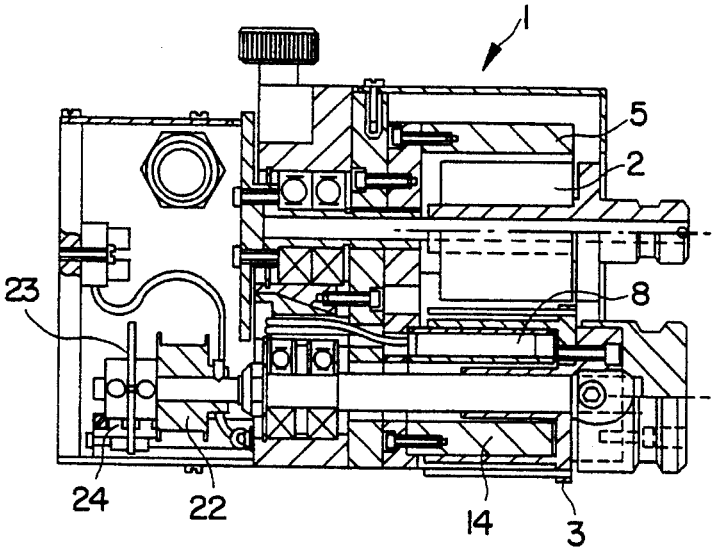
Figure 6E:
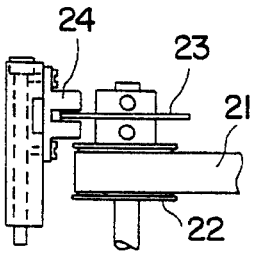
Figure 6G:
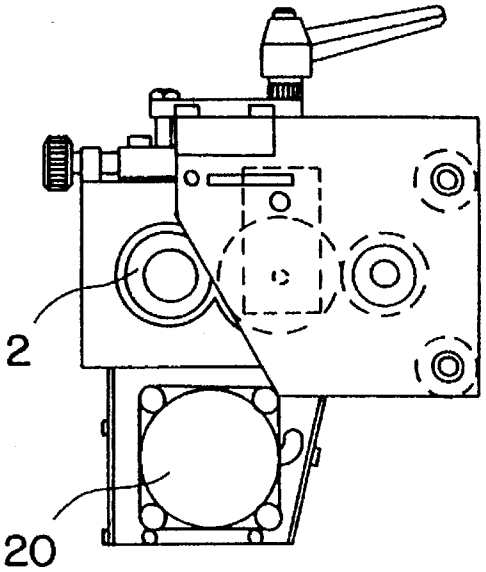
Figure 6F:
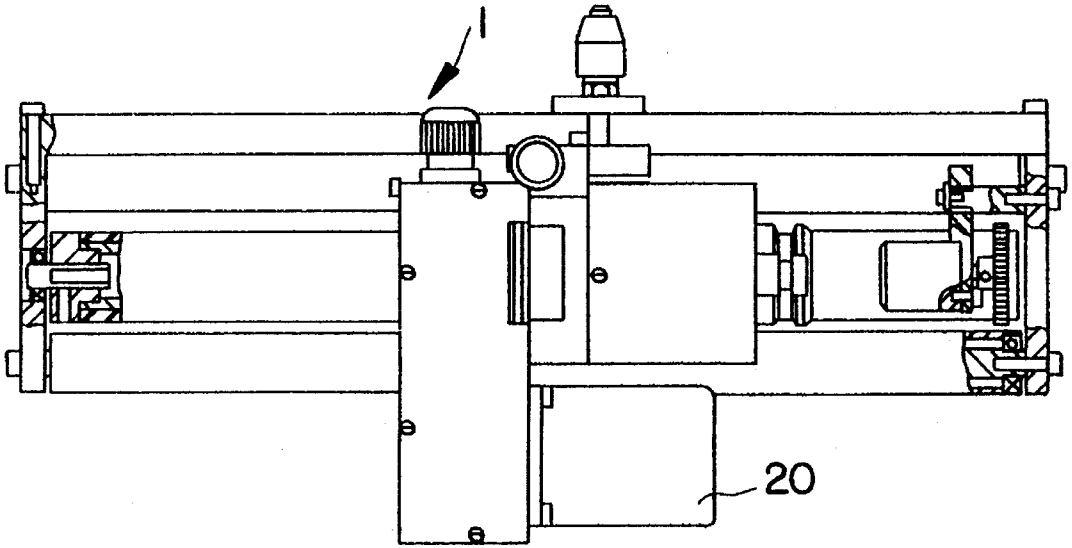

In FIG. 4 is shown a trigger input circuit to prevent noise from causing incorrect start signals. In this circuit an oscillator drives a counter which is normally in the reset mode and thus there is no trigger input. A trigger input signal pulls the reset down to ground and allows the counter to count to more than seven. Any noise on the trigger input switching will quickly reset the counter again and no trigger input will be generated. The trigger output will only be generated when the input remains low for seven oscillator cycle and a bistable circuit is triggered which allows a Warner Single Revolution Clutch-Brake to rotate the print drum. This is established by means of a pre-set digital positioning delay such as shown in FIG. 5 which is used to position the print on the film. This delay is in increments of say, 0.5 mm and remains stable for all web speeds. The encoder increments a BCD Counter and when the counter output equals the setting on the BCD switches a trigger pulse is generated and the clutch-brake is activated. The counter is held in 'reset' until a print start signal from a photoeye or microswitch is present. Thus it can be seen that the photoeye or microswitch initiates the signal for printing and the encoder allows a set distance for an output signal to be provided.

However, the pitch of specified indicia can be required to vary over a wide range but the print drum circumference is a fixed distance. The Warner Single Revolution Clutch-Brake can be fitted with a single stop collar which allows the clutch and print drum to rotate one full turn. It can also be fitted with a two stop collar which allows the clutch and print drum to rotate half turns only. In this case two sets of type are fitted to the print drum and the indicia can be printed at shorter spacings. Three to four stop collars can also be fitted for even shorter pitches. Typically, the circumference may be 160 mm so that indicia can be placed at an 80 mm pitch with a 2 stop collar. Because the range required can fall between 70 to 160 or over, it is not convenient to change stop collar each time the pitch changes. The clutch may be fitted with a two stop collar and an encoder is provided so that after the input signal is initiated to the device a decimal counter switch can then set to count the required pulses from the encoder and thus produce one half of the print drum, say an 80 mm pitch to any distance to 160 mm or over can be obtained without changing the stop collar on the clutch.

Another important aspect of this invention is the use of timing belts and timing pulleys to couple the input resilient covered friction roller to the clutch and print drum. This ensures that the print will be accurately placed in relation to any pre-printed indicia on the web. In order to prevent blurring of the print it is important to eliminate any backlash between the print drum and the friction roller. An adjustable tensioner arm may therefore be fitted so that any slack in the timing belt can be taken up.

Type used in hot roll devices is usually made from engraved brass segments which can be arranged to be secured around the circumference or across the length of the print drum, depending on the way the print is required to appear on the packaging film. Such type is relatively expensive to manufacture and accordingly a preferred embodiment of the device uses type moulded from a silicone elastomer which is easy to produce, and can be readily supplied with particular wording such as one piece batch codes or product names.

Because the hot ink rollers used are not always of the same diameter, the type in the print drum will sometimes barely contact the ink rollers and at other times will be heavy in contact with it. Accordingly, the print on the packaging film could be under or over inked.

Therefore, this invention also proposes the use of an eccentric mounted spindle for the hot ink roller, which has a numbered disc attached. Rotation of the disc allows the hot ink roller to be advanced towards or retracted from the type on the print drum thus enabling the required amount of ink to be obtained. A spring detent retains the disc in the ideal position for each particular hot ink roller.

In the embodiment of the printing device hereinbefore described, particularly with reference to FIG. 2, the travelling web causes the print head to rotate by means of a friction driven roller which in turn drives the input shaft of a single revolution clutch. This clutch can rotate continuously until signalled by the encoder to drive the print drum. Because of the importance of the friction drive to the clutch, the film is made to follow a path which gives approximately a 90 degree wrap around a resiliently coated, preferably polyurethane coated, roller which drives the clutch. Only under ideal conditions will a straight line film provide sufficient friction drive for accurate print positions.

An alternative and further preferred embodiment of the coding device uses a stepper motor drive for the print drum in place of the friction driven single revolution clutch, and such a model does not require the offset path of the film as a friction drive is not required with a stepper motor driven print drum. Such a model is controlled also with an encoder which keeps the motor speed identical to the film speed and hence the print pitch is accurately positioned.

Such an alternative embodiment, utilising a stepper motor drive is described briefly hereinafter with reference to FIG. 6(*a*) to 6(*g*). In FIG. 6(*a*) is shown a plan view of the preferred embodiment of the stepper motor driven printing apparatus, whilst FIG. 6(*b*), 6(*c*) and 6(*d*) detail right hand side, left hand side and front views of that apparatus, respectively. FIG. 6(*e*) details the means by which the print drum is accurately positioned, using a photo eye arrangement, whilst FIGS. 6(*f*) and 6(*g*) show the bracket arrangement, in plan and right hand elevational views thereof, respectively, such that accurate positioning of the apparatus within a packaging machine is enabled. Briefly, referring to FIG. 6 the stepping motor 20 drives the print drum via timing belt 21 and pulleys 22. The print drum is accurately positioned radially by means of a disc 23 and a photoeye 24. The disc 23 has 1, 2 or 4 radial slots in it so that the drum is always stopped electronically by the stepping motor at the same position after each print is made.

A further preferred embodiment of the coding device uses a single revolution clutch to drive the print drum but the input shaft to the clutch is directly coupled to a suitable driven shaft in the packaging machine. This arrangement does not require a friction drive, stepper motor or encoder, as the positioning of the print drum is intimately controlled by the packaging machine.

With any of the above embodiments the print drum is preferably capable of being removed and replaced and type changed, without altering the relative print position of the print drum to the input shaft. Thus the print drum is provided with a cross pin to engage in a slot in the output shaft which serves to drive the print drum as well as maintain the correct print position.

It will be appreciated that the present invention provides many varied and unique features which may be incorporated separately or in any combination, to form a printing apparatus which has distinct differences and advantages over prior art printing devices.

All such variations and modifications to the printing apparatus described hereinbefore should be considered to fall within the scope of the present invention.

I claim:

1. A printing apparatus comprising:

a print drum having at least one printing element thereon;

an ink roller, for inking the printing element with an ink composition of the type which is solid at ambient temperatures and which is liquid at elevated temperatures;

a heating block substantially surrounding said ink roller, to radiantly heat said ink roller, and, heating means, independent of the heating block, within said print drum to heat said printing element.

2. A printing apparatus as claimed in claim 1, further comprising control means to control the heating operation of at least one of said heating block and heating means.

3. A printing apparatus as claimed in claim 1, for printing printed indicia at spaced intervals on a web of material to be used as packaging.

4. A printing apparatus as claimed in claim 3, wherein movement of said print drum and said web of material through said apparatus is achieved by a clutch brake.

5. A printing apparatus as claimed in claim 3, wherein, movement of said print drum and said web of material through said apparatus is achieved by a stepper motor drive.

6. A printing apparatus comprising:

a print drum having at least one printing element thereon;

an ink roller, for inking the printing element with an ink composition of the type which is solid at ambient temperatures and which is liquid at elevated temperatures;

a heating block substantially surrounding said ink roller, to radiantly heat said ink roller, and, heating means within said print drum to heat said printing element, wherein said inking roller is eccentrically mounted.

7. A printing apparatus comprising:

a print drum having at least one printing element thereon:

an ink roller, for inking the printing element with an ink composition of the type which is solid at ambient temperatures and which is liquid at elevated temperatures;

a heating block substantially surrounding said ink roller, to radiantly heat said ink roller;

heating means within said print drum to heat said printing element; and, control means to control the heating operation of at least one of said heating block and heating means:

wherein to control the temperature of at least one of said heating block and said heating means, said control means comprises:

means responsive to the temperature of said one of said heating block and said heating means, and producing a temperature signal;

summing means to sum the said temperature signal to a periodically variable waveform signal;

comparator means to compare said summed signal with a present temperature; and, switching means to operate said one of said heating block and said heating means when said summed signal is larger than said preset value.

8. A printing apparatus as claimed in claim 7, wherein said periodically variable waveform signal is a triangular waveform signal.

9. A printing apparatus as claimed in claim 7, further comprising means providing a start signal once said summed signal is larger than said preset value, for causing material to be printed to be conveyed under said print drum.

10. A printing apparatus as claimed in claim 9, wherein said material is a web of film of packaging material.

11. A printing apparatus as claimed in claim 9 further comprising monitoring means to monitor at least one of the parameters of said printed material, said parameters being position and quality, and provide a feedback signal to control the further operation of said apparatus.

12. A printing apparatus as claimed in claim 9 further comprising monitoring means to monitor at least one of the parameters of said printed material, said parameters being position and quality, and provide a feedback signal to control the speed of said material to be printed thereon.

13. A printing apparatus as claimed in claim 9, further comprising monitoring means to monitor the position of said print drum, said monitoring means comprising a disc provided with at least one radial slot therein and photoelectric detection means arranged to cooperate with said disc.

14. A printing apparatus for printing printed indicia at spaced intervals on a web of material to be used as packaging, comprising:

a print drum having at least one printing element thereon;

means, responsive to a start signal, for causing rotation of the print drum;

an ink roller, for inking the printing element with an ink composition of the type which is solid at ambient temperatures and which is liquid at elevated temperatures;

a heating block substantially surrounding said ink roller, to radiantly heat said ink roller, heating means within said print drum to heat said printing element, and trigger means to prevent other signals from causing an incorrect start of the print drum.

* * * * *